US010329085B2

(12) United States Patent
Filion

(10) Patent No.: US 10,329,085 B2
(45) Date of Patent: Jun. 25, 2019

(54) ROTATIONALLY OPERABLE BIN LINER FOR USE IN A REFUSE RECEPTACLE

(71) Applicant: Green Siteworks, LLC, Grand Rapids, MI (US)

(72) Inventor: Michael S. Filion, Grand Rapids, MI (US)

(73) Assignee: Green Siteworks, LLC, Grand Rapids, MI (US)

( * ) Notice: Subject to any disclaimer, the term of this patent is extended or adjusted under 35 U.S.C. 154(b) by 266 days.

(21) Appl. No.: 15/297,541

(22) Filed: Oct. 19, 2016

(65) Prior Publication Data

US 2018/0105358 A1 Apr. 19, 2018

(51) Int. Cl.

| | |
|---|---|
| ***B65F 1/06*** | (2006.01) |
| ***B65F 1/08*** | (2006.01) |
| ***B65F 1/14*** | (2006.01) |

(52) U.S. Cl.

CPC ..... *B65F 1/068* (2013.01); *B65F 1/08* (2013.01); *B65F 1/1415* (2013.01); *B65F 2250/114* (2013.01)

(58) Field of Classification Search

CPC .... B65F 1/068; B65F 1/04; B65F 1/08; B65F 1/1415

See application file for complete search history.

(56) References Cited

U.S. PATENT DOCUMENTS

| | | | | |
|---|---|---|---|---|
| 1,351,747 | A | 9/1920 | Flinn | |
| 1,645,100 | A | 10/1927 | Geibel | |
| 2,324,440 | A | 7/1943 | Tormohlen | |
| 2,798,637 | A | 7/1957 | Wachter | |
| 2,946,474 | A | 7/1960 | Knapp | |
| 4,081,105 | A | 3/1978 | Dagonnet et al. | |
| 5,183,175 | A | 2/1993 | Brown | |
| 7,077,283 | B2 | 7/2006 | Yang et al. | |
| 9,238,549 | B2 | 1/2016 | Merey | |
| 2016/0236863 | A1* | 8/2016 | Wall | B65F 1/08 |

* cited by examiner

*Primary Examiner* — Andrew T Kirsch
*Assistant Examiner* — Don M Anderson
(74) *Attorney, Agent, or Firm* — Price Heneveld LLP

(57) ABSTRACT

A refuse bin includes a frame defining an interior cavity and a seating structure. A bin liner has a biasing surface that rotationally engages the seating structure to define a recessed first position characterized by the bin liner set within the interior cavity. An elevated second position is characterized by the bin liner being vertically offset from the frame. The first position is vertically and rotationally distal from the second position. A bag retaining mechanism is defined between the frame and the bin liner. The first position defines a secured state of the bag retaining mechanism and the second position defines a maintenance state of the bag retaining mechanism.

19 Claims, 8 Drawing Sheets

Method 400 for Operating a Refuse Bin Having a Bin Liner with at least One Biasing Surface

ROTATIONALLY OPERABLE BIN LINER FOR USE IN A REFUSE RECEPTACLE

FIELD OF THE INVENTION

The present invention generally relates to refuse receptacles, and more specifically, a refuse receptacle having a rotationally operable liner that rotates to operate a bag retaining mechanism for the refuse receptacle.

BACKGROUND OF THE INVENTION

In various waste receptacles, an inner liner is included, where the inner liner is disposed within a decorative outer frame. The liner is fully or partially removable from the decorative outer frame in order to install and remove trash bags for holding waste disposed within the waste receptacle. These bags are replaced typically on a daily basis such that frequent manipulation of the liner within the decorative frame is necessary to replace the trash bags disposed within the liner.

SUMMARY OF THE INVENTION

According to one aspect of the present invention, a refuse bin includes a frame defining an interior cavity and a seating structure. A bin liner has a biasing surface that rotationally engages the seating structure to define a recessed first position characterized by the bin liner set within the interior cavity. An elevated second position is characterized by the bin liner being vertically offset from the frame. The first position is vertically and rotationally distal from the second position. A bag retaining mechanism is defined between the frame and the bin liner. The first position defines a secured state of the bag retaining mechanism and the second position defines a maintenance state of the bag retaining mechanism.

According to another aspect of the present invention, a refuse bin includes a bin liner rotationally operable relative to a seating structure to define first and second positions of the bin liner. The second position is rotationally distal from the first position. The refuse bin includes a bag retaining mechanism wherein the first position defines a secured state of the bag retaining mechanism adapted to secure the bin liner to a portion of the bag retaining mechanism and wherein the second position defines a maintenance state of the bag retaining mechanism adapted to separate the bin liner from the portion of the bag retaining mechanism.

According to another aspect of the present invention, a refuse bin includes a bin liner selectively engaged with a seating structure and rotationally operable relative to the seating structure between first and second positions. The second position is rotationally and vertically distal from the first position, wherein the second position is adapted to define a separation of the bin liner from a portion of a bag retaining mechanism.

According to another aspect of the present invention, a method for operating a refuse bin having a bin liner with at least one biasing surface includes rotating a bin liner within a frame from a recessed first position to an elevated second position. The method also includes placing a bag within the bin liner and over an upper edge of the bin liner in the elevated second position. The method also includes rotating the bin liner from the elevated second position to the recessed first position to secure a portion of the bag between the bin liner and the frame.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
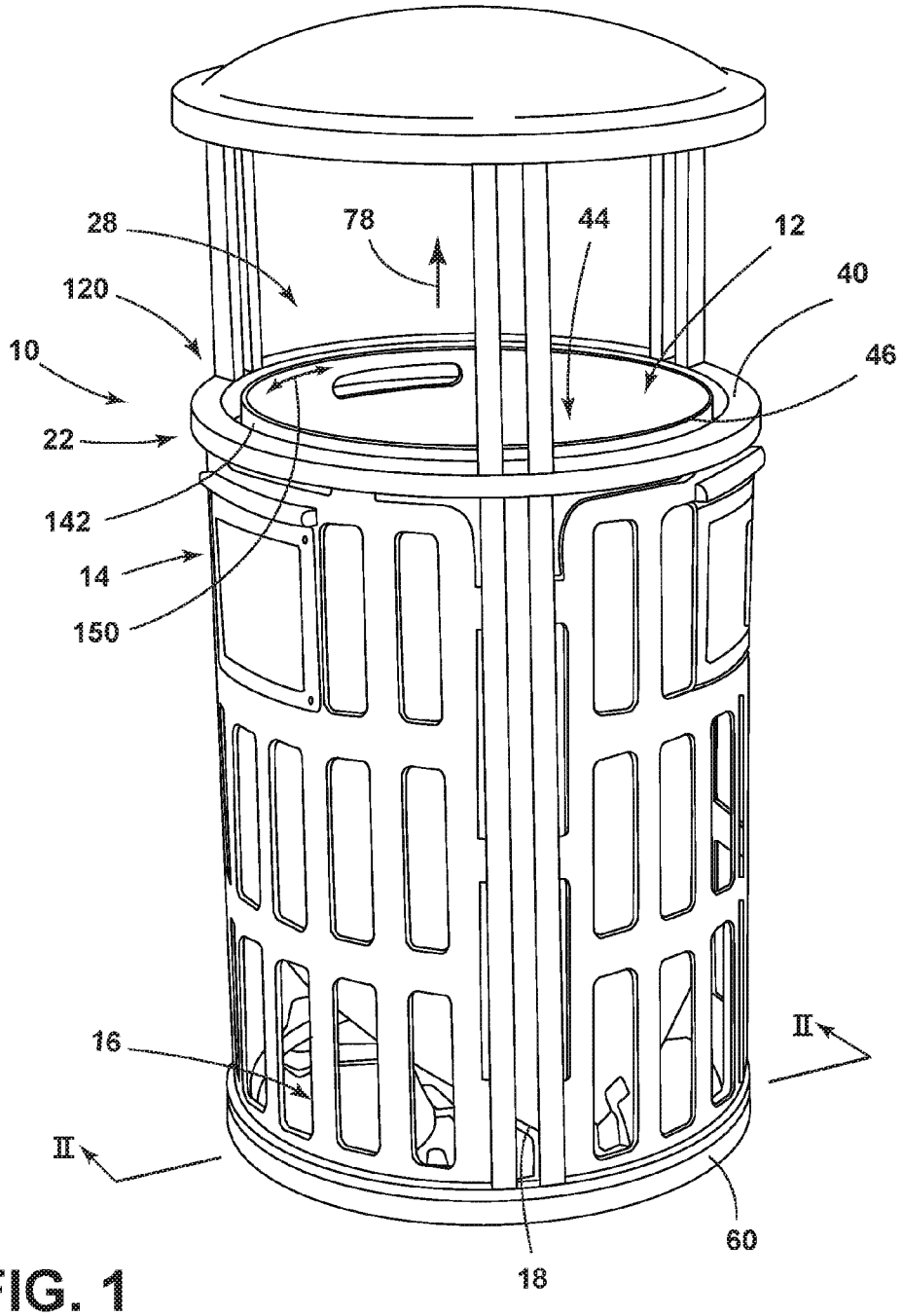
FIG. 1 is a perspective view of a refuse bin having an aspect of the bin liner disposed within a frame in a first position.
Figure 2:
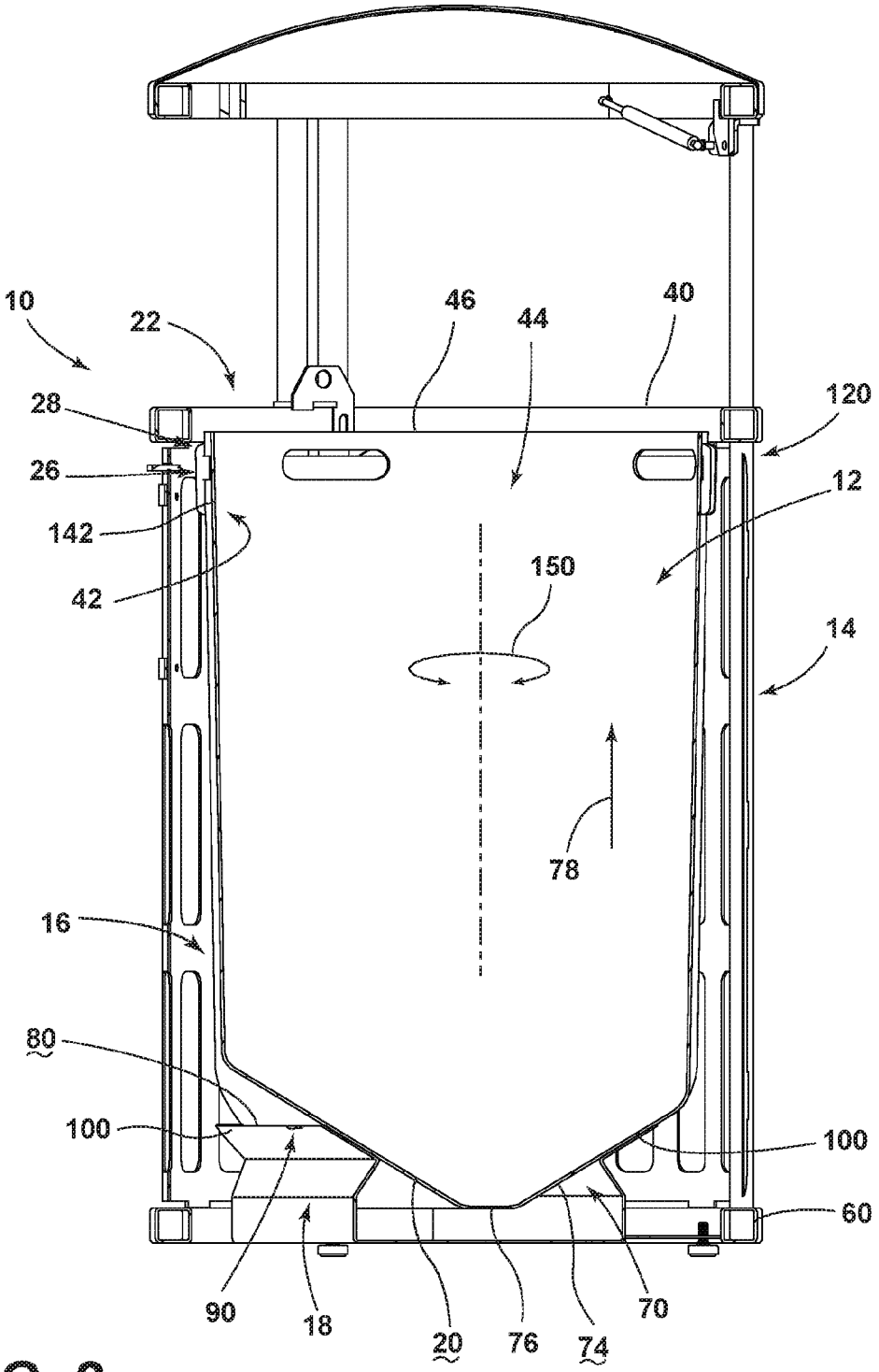
FIG. 2 is a cross-sectional view of the refuse bin of FIG. 1 taken along line II-II.
Figure 3:
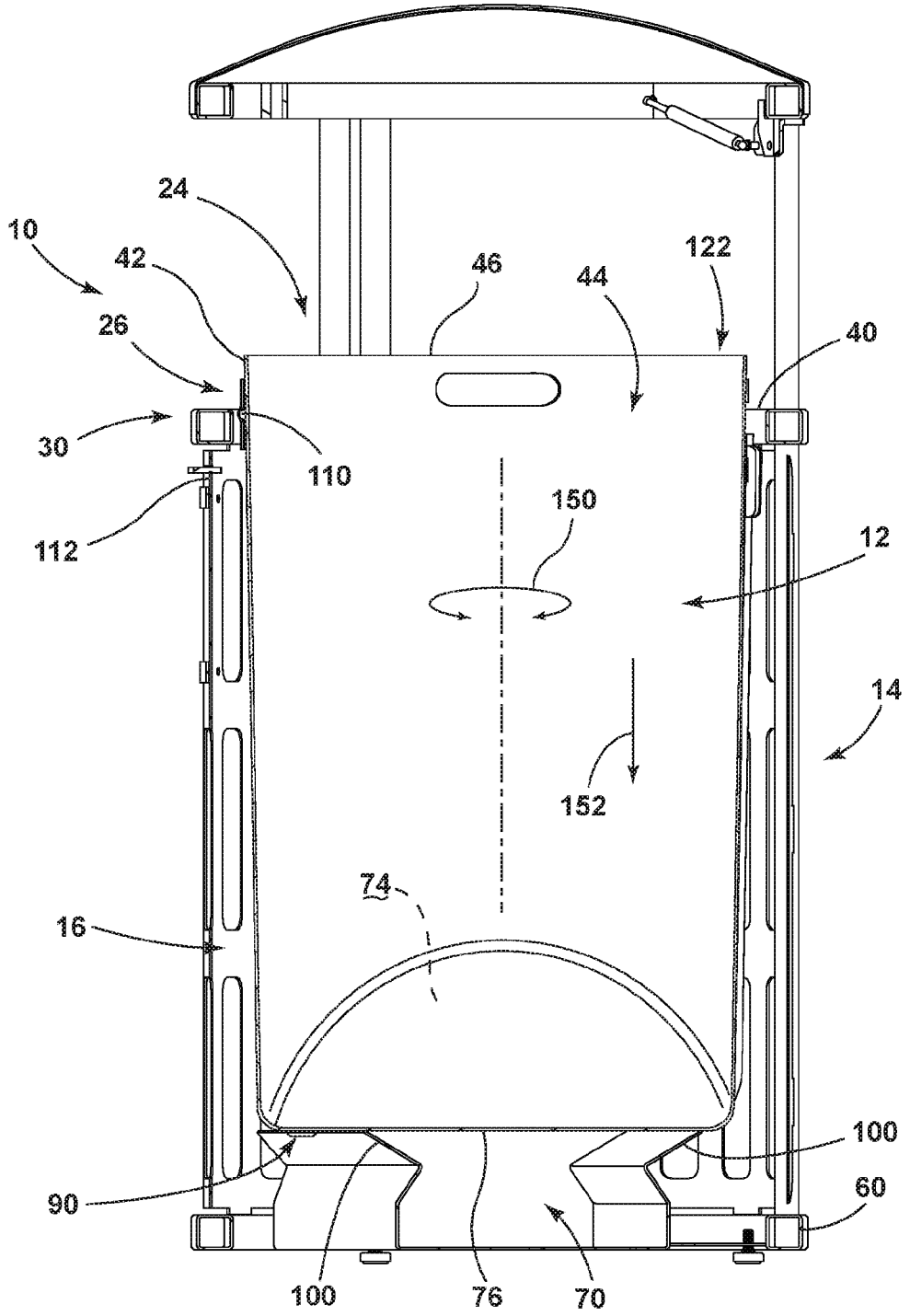
FIG. 3 is a cross-sectional view of the refuse bin of FIG. 2 showing the inner liner rotated into the second position.
Figure 4:
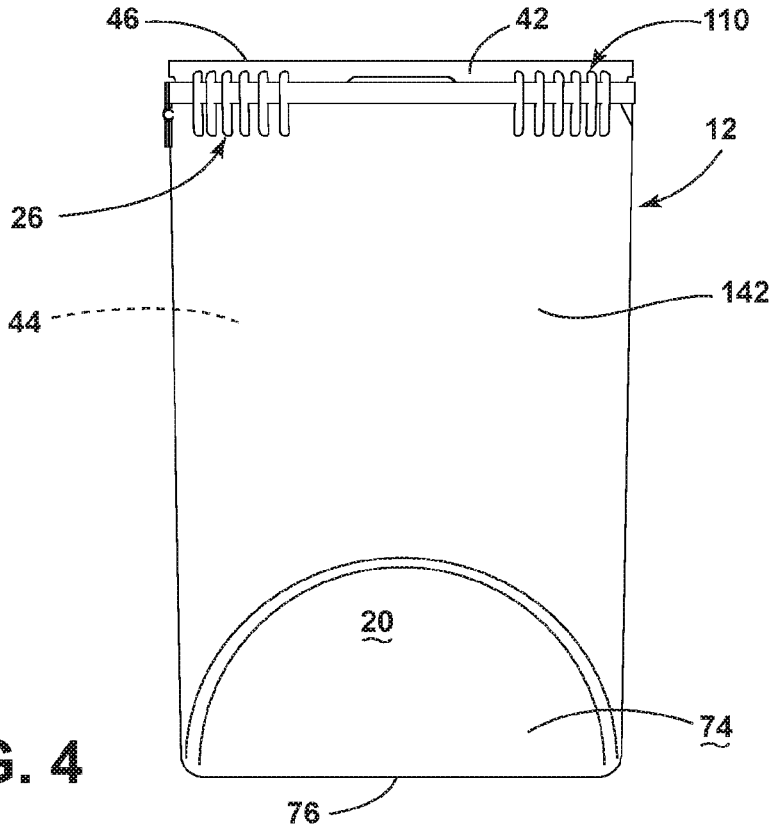
FIG. 4 is a first side elevational view of an aspect of a bin liner having a biasing surface disposed at a bottom of the bin liner.
Figure 5:
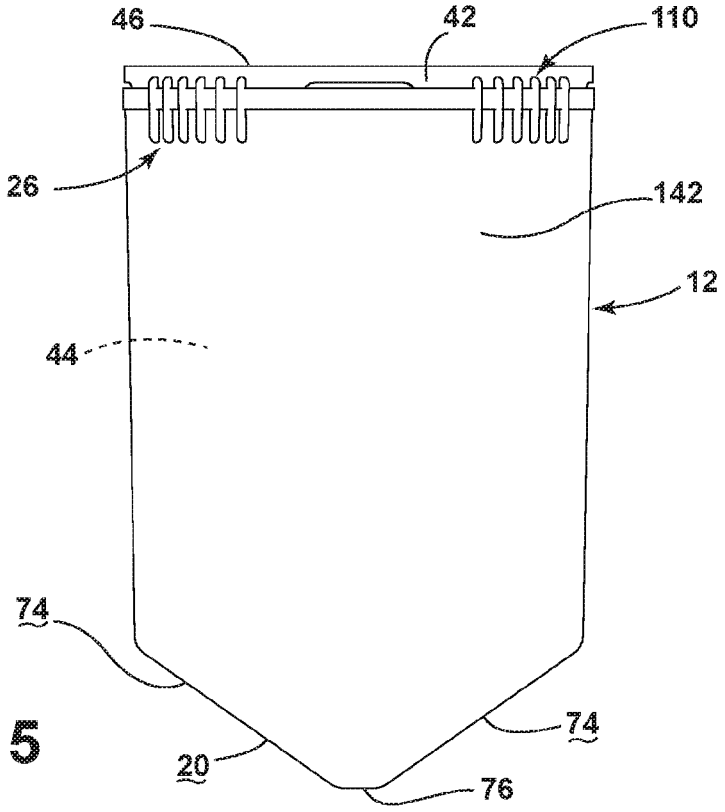
FIG. 5 is a second elevational view of the bin liner of FIG. 4.
Figure 6:
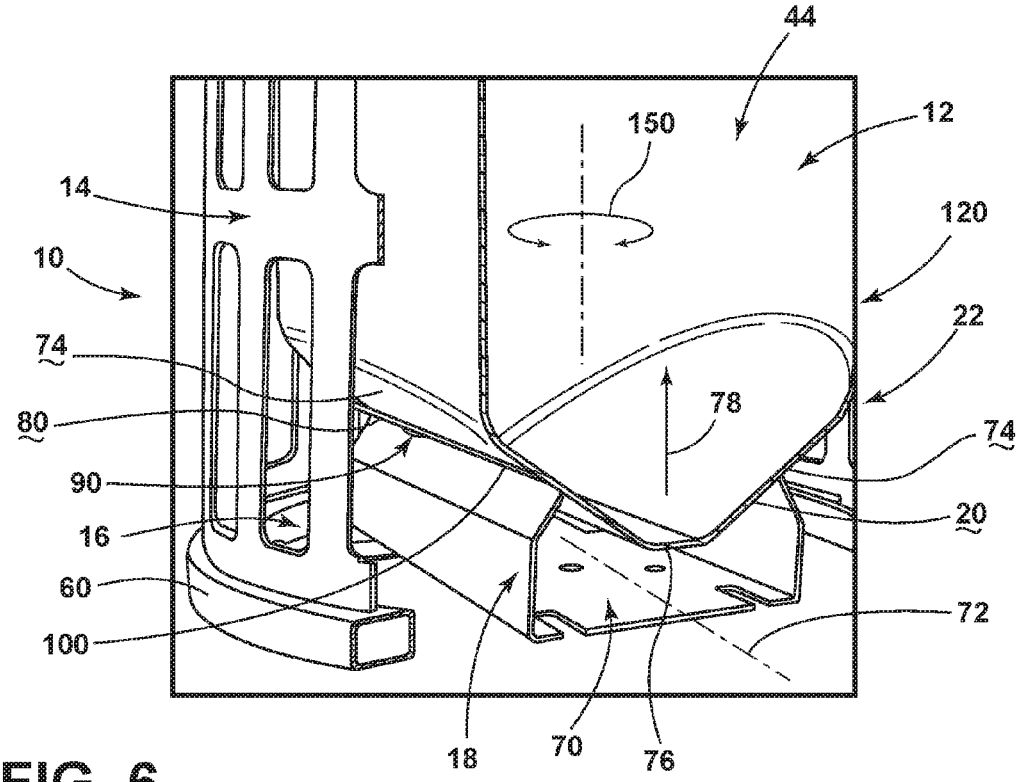
FIG. 6 is an enlarged cross-sectional view an aspect of the bin liner and seating structure in the first position.
Figure 7:
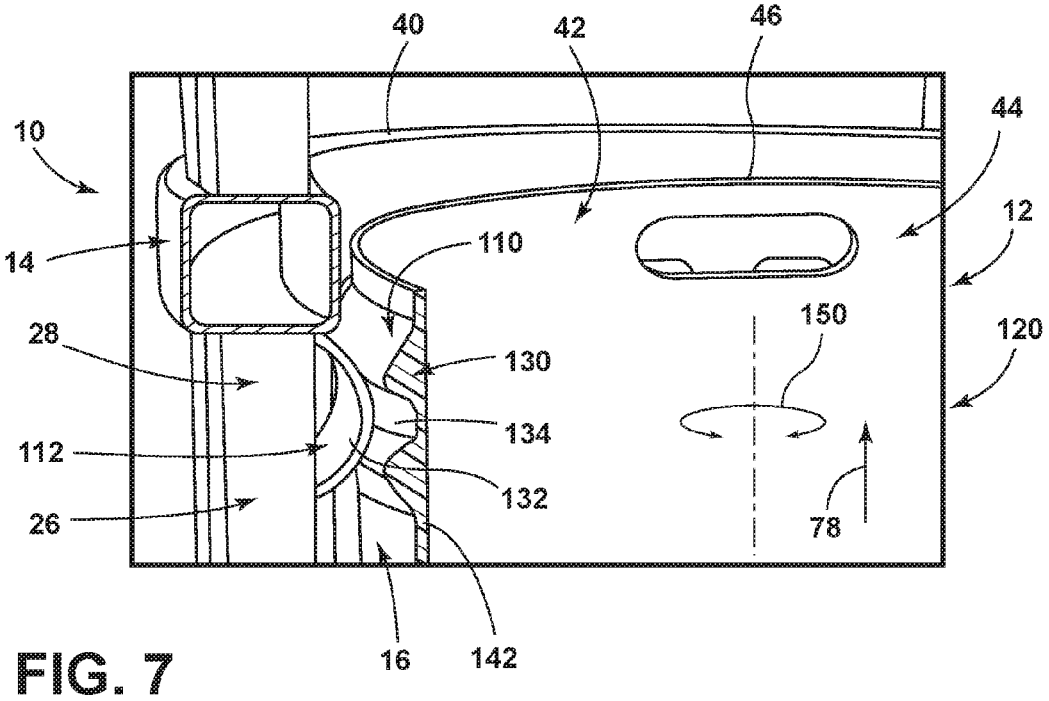
FIG. 7 is an enlarged cross-sectional view of an aspect of the bin liner and frame in the first position.
Figure 8:
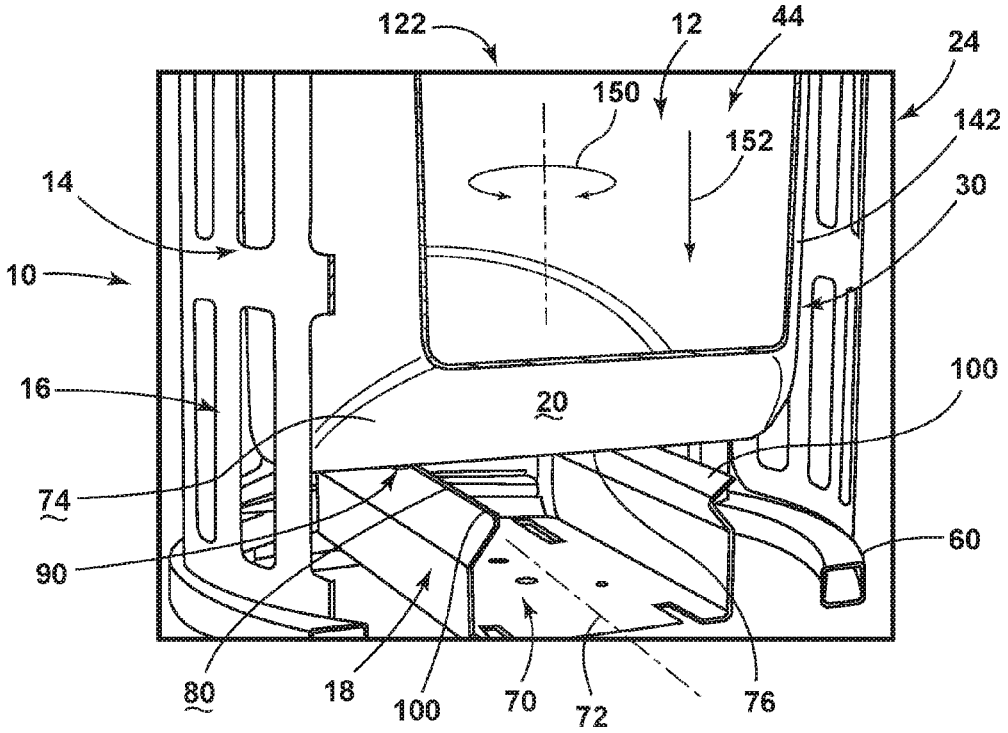
FIG. 8 is an enlarged cross-sectional view of an aspect of the bin liner and seating structure in the second position.
Figure 9:
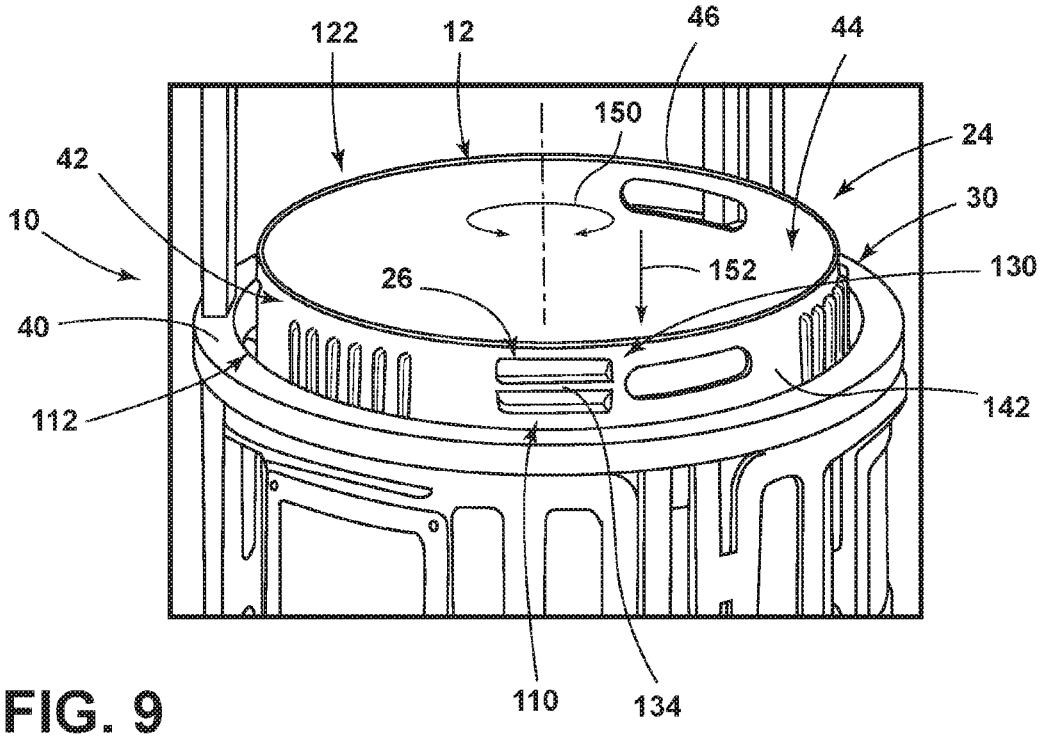
FIG. 9 is a top perspective view of an aspect of the refuse bin and showing the bin liner in the second position.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As shown in FIGS. 1-9, reference numeral 10 generally refers to a refuse bin adapted to receive a bin liner 12 within a frame 14, where the bin liner 12 is rotationally operable within the frame 14 to define a plurality of rotational positions and various vertical positions of the bin liner 12 with respect to the frame 14.

Referring again to FIGS. 1-9, a refuse bin 10 includes a frame 14 that defines an interior cavity 16 and a seating structure 18. The bin liner 12 includes a biasing surface 20 that rotationally engages the seating structure 18 to define a recessed first position 22. The recessed first position 22 is characterized by the bin liner 12 being disposed within, typically entirely within, the interior cavity 16. The biasing surface 20 of the bin liner 12 also rotationally engages the seating structure 18 to define an elevated second position 24, where the recessed first position 22 is vertically and rotationally distal from the elevated second position 24. The elevated second position 24 is characterized by the bin liner 12 being vertically offset from the frame 14. A bag retaining mechanism 26 is defined between the frame 14 and the bin liner 12. It is contemplated that the recessed first position 22 defines a secured state 28 of the bag retaining mechanism 26 and the elevated second position 24 defines a maintenance state 30 of the bag retaining mechanism 26.

Referring again to FIGS. 1-9, according to the various embodiments, rotation of the bin liner 12 in either clockwise or counter-clockwise direction, within the seating structure 18 between the first and second position 22, 24 rotates the bin liner 12 within the interior cavity 16 and also elevates the bin liner 12 between a plurality of vertical positions. Typically, the first position 22 is defined by a lower and recessed first position 22, again in either direction, with respect to the seating structure 18. The second position 24, which is rotationally distal from the first position 22, results in the bin liner 12 being elevated within the interior cavity 16 such that at least a portion of the bin liner 12 extends above an upper edge 40 of the frame 14 defining the interior cavity 16. In this manner, portions of the bin liner 12 can be made accessible to a user when the bin liner 12 is rotated to the elevated second position 24. In this elevated second position 24, the user can more conveniently access an upper portion 42 of the bin liner 12 to remove a previously positioned trash bag (not shown) from within the bin liner 12 that may be loaded with trash, recyclables, and other refuse. Additionally, with the bin liner 12 in this elevated second position 24, the user can easily replace the old bag with a new bag by placing a portion of the bag within the interior space 44 of the bin liner 12 and extending a portion of the bag around the upper rim 46 of the bin liner 12. When the user rotates the bin liner 12 back to the recessed first position 22, the bin liner 12 is moved downward, such that a portion of the bag is retained within the bag retaining mechanism 26 and secured between a portion of the bin liner 12 and the frame 14.

Referring again to FIGS. 1-10, it is contemplated that the seating structure 18 can be incorporated within the interior cavity 16 of the frame 14. Typically, the seating structure 18 is defined proximate a base 60 of the frame 14, although the seating structure 18 may be positioned in other portions of the interior cavity 16 for the frame 14.

As exemplified in FIGS. 1-9, the seating structure 18 can include a seating channel 70 having a primary axis 72 that extends along the seating channel 70. In such an embodiment, the bin liner 12 can include a base 60 having opposing biasing surfaces 74 that extend toward a bottom ridge 76. It is contemplated that alignment of a bottom ridge 76 with the primary axis 72 of the seating channel 70 positions the bottom ridge 76 within the seating channel 70 to define the recessed first position 22. Rotation of the bin liner 12 to the second position 24 serves to rotate the opposing biasing surfaces 74 and the bottom ridge 76 within the seating channel 70. The opposing biasing surfaces 74 bias the bin liner 12 upward as they slide against the seating channel 70. This sliding engagement between the opposing biasing surfaces 74 and the seating channel 70 defines a generally upward vertical movement 78 of the bin liner 12 to define a second position 24. Additionally, it is contemplated that the elevated second position 24 is defined by the bottom ridge 76 of the bin liner 12 being out of alignment with the primary axis 72 of the seating channel 70. The second position 24 is also defined by the bottom ridge 76 of the bin liner 12 resting on a top surface 80 of the seating channel 70.

Referring again to FIGS. 1-9, it is contemplated that a seating channel 70 can include a detent portion 90 proximate a top surface 80 of the seating channel 70. This detent portion 90 can be defined by recesses, indents, apertures, or other structural features that serve to at least partially define the second position 24 of the bin liner 12. In such an embodiment, engagement of the bottom ridge 76 of the bin liner 12 within the detent portion 90 defined within the top surface 80 of the seating channel 70 serves to substantially secure the bottom ridge 76 in the second position 24. It is contemplated that this detent portion 90 can also be defined by positive features that extend upward from portions of the seating channel 70, such that these protrusions, tabs, ridges, inclines, and other features serve to define a resting position of the bin liner 12 in the second position 24. The use of the detent portion 90 serves to maintain the position of the bin liner 12 in the second position 24 while the user accesses the bag that is positioned within and extends partially around the bin liner 12. This configuration provides a hands-free positioning of the bin liner 12 with respect to the frame 14. Additionally, this configuration incorporating the detent portion 90 can allow a single individual using the refuse bin 10 to use both hands to access the bin liner 12, manipulate the bag within the bin liner 12 and replace the old bag with a new bag as necessary.

Referring again to FIGS. 1-9, it is contemplated that rotation of the bin liner 12 from the first position 22 to the second position 24 slidably engages opposing biasing surfaces 74 against opposing flanges 100 of the seating channel 70. This slidable engagement of the opposing biasing surfaces 74 against the opposing flanges 100 serves to upwardly bias the opposing biasing surfaces 74 in a generally upward vertical movement 78. Additionally, rotation of the bin liner 12 from the second position 24 back to the first position 22 serves to slidably engage the opposing biasing surfaces 74 against the opposing flanges 100 of the seating channel 70. As the bin liner 12 is rotated back to the first position 22, the sliding engagement of the opposing biasing surfaces 74 with the opposing flanges 100 biases the bottom ridge 76 in a downward vertical movement 152 back into the seating channel 70 and into alignment with the primary axis 72 to define the recessed first position 22 of the bin liner 12.

Referring again to FIGS. 1-9, it is contemplated that the refuse bin 10 can include the bin liner 12 that is rotationally operable relative to the seating structure 18. In this manner, rotation of the bin liner 12 serves to define first and second positions 22, 24 of the bin liner 12. As discussed above, the second position 24 is adapted to be rotationally distal from the first position 22. According to the various embodiments, a bag retaining mechanism 26 can be included proximate the bin liner 12, wherein the first position 22 defines a secured state 28 of the bag retaining mechanism 26. The bag retaining mechanism 26 in the secured state 28 is adapted to secure the bin liner 12 to a portion of the bag retaining mechanism 26. Movement of the bin liner 12 to the second position 24 serves to define a maintenance state 30 of the bag retaining mechanism 26. This maintenance state 30 is defined by a separation of at least a portion of the bin liner 12 from at least a portion of the bag retaining mechanism 26. This separation of the bin liner 12 with various portions of the bag retaining mechanism 26 serves to provide access for the user to manipulate the bag within the bin liner 12.

According to the various embodiments, rotation of the bin liner 12 between the first and second positions 22, 24 that corresponds to the secured and maintenance states 28, 30 of the bag retaining mechanism 26 may be limited to rotation of the bin liner 12 within the frame 14 without substantial vertical translation. Accordingly, the frame 14 and/or the bin liner 12 may include various enlarged portions that are adapted to align in the second position 24 and separate a liner portion 110 of the bag retaining mechanism 26 from a frame portion 112 of the bag retaining mechanism 26. This separation of the liner and frame portions 112 of the bag retaining mechanism 26 serve to define the maintenance state 30, such that the user can access the bag sufficiently to remove and replace the bag as necessary.

Referring again to FIGS. 1-20, typically, rotation of the bin liner 12 between the first and second positions 22, 24 will also result in upward and downward vertical movement 78, 152 of the bin liner 12 within the frame 14 such that at least a portion of the bin liner 12 extends above portions of the frame 14. In this condition, separation of the liner and frame portions 110, 112 of the bag retaining mechanism 26 will occur, indicative of the maintenance state 30 of the bag retaining mechanism 26. When the bin liner 12 is rotated back to the first position 22, the bin liner 12 is lowered, such that the liner portion 110 of the bag retaining mechanism 26 is placed back into engagement with the frame portion 112 of the bag retaining mechanism 26 to secure a portion of the bag therebetween. This engagement of the liner and frame portions 110, 112 of the bag retaining mechanism 26 is indicative of the secured state 28 of the bag retaining mechanism 26.

Referring again to FIGS. 1-10, it is contemplated that the first position 22 defines a first vertical position 120 with respect to the seating structure 18. Additionally, the second position 24 of the bin liner 12 serves to define a second vertical position 122 with respect to the seating structure 18, where a second vertical position 122 is vertically distal, and typically above, the first vertical position 120.

Referring now to FIGS. 1-9, it is contemplated that the refuse bin 10 can include the frame 14 that defines the interior cavity 16. As discussed previously, the bin liner 12 is rotationally operable within the interior cavity 16 to engage the seating structure 18. It is contemplated that the seating structure 18 can be at least partially defined within the frame 14. Rotation of the bin liner 12 between the first and second positions 22, 24 vertically operates the bin liner 12 within the frame 14 between the first and second vertical positions 120, 122. As discussed above, the second vertical position 122 is typically above the first vertical position 120.

Referring again to the various aspects of the devices exemplified in FIGS. 1-10, a bin liner 12 is adapted to be selectively engaged with a seating structure 18. The bin liner 12 is selectively and rotationally operable relative to the seating structure 18 between the first and second positions 22, 24. The second position 24 is rotationally and vertically distal from the first position 22. It is contemplated that the second position 24 is adapted to define a separation of the bin liner 12 from at least a portion of the bag retaining mechanism 26.

Referring again to FIGS. 1-10, the frame 14 of the refuse bin 10 can define the interior cavity 16. The bin liner 12 is adapted to be rotationally operable within the interior cavity 16 to engage the seating structure 18. It is contemplated that the seating structure 18 is at least partially defined within the frame 14 and rotation of the bin liner 12 within the first and second positions 22, 24 serves to vertically operate the bin liner 12 within the frame 14. Additionally, the bag retaining mechanism 26 can include the liner portion 110 and the frame portion 112. It is contemplated that the first position 22 of the bin liner 12 corresponds to the secured state 28 of the bag retaining mechanism 26. The secured state 28 of the bag retaining mechanism 26 is characterized by the liner portion 110 of the bag retaining mechanism 26 engaging the frame portion 112 of the bag retaining mechanisms 26. Conversely, the second position 24 of the bin liner 12 corresponds to the maintenance state 30 of the bag retaining mechanism 26. The maintenance state 30 is characterized by the liner portion 110 of the bag retaining mechanism 26 being positioned distal from the frame portion 112 of the bag retaining mechanism 26. As discussed previously, the maintenance state 30 of the bag retaining mechanism 26 is adapted to allow for convenient removal of a bag from the bin liner 12 by hand and without the use of tools. Additionally, the maintenance state 30 serves to allow for removal of the bag without causing any significant damage to the bag as the bag is removed from the bin liner 12 in the second position 24. When the bin liner 12 is in the first position 22, the bag is securely retained between the bin liner 12 and the frame 14, and more specifically between the liner portion 110 and frame portion 112 of the bag retaining mechanism 26.

Referring again to FIGS. 1-10, it is contemplated that the bag retaining mechanism 26 can be defined by various mechanical retaining mechanisms that are defined between the bin liner 12 and the frame 14. Such retaining mechanisms can include a mating channel 130 and protrusion 132 defined within the bin liner 12 and the frame 14. In such an embodiment, the protrusion 132 at least partially seats within a portion of the mating channel 130. In this manner, engagement between the protrusion 132 and the mating channel 130 in the secured position forms an at least partial labyrinth engagement or interference engagement that secures the bag therebetween. According to the various embodiments, the protrusion 132 can include a flexible member or a deflecting portion that can deflect as the bin liner 12 is moved between the first and second positions 22, 24. As the bin liner 12 is moved between the first and second positions 22, 24, a deflecting protrusion 132 can deflect to allow portions of the mating channel 130 to pass thereby, such that the deflecting protrusion 132 can seat within a central portion 134 of the mating channel 130. It is also contemplated that the protrusion 132 can be rigid and the bin liner 12 can flex to allow for engagement between the mating channel 130 and the protrusion 132.

According to various embodiments, it is contemplated that the bag retaining mechanism 26 can include other interference and/or labyrinth-type engagements that serve to retain the bag between the liner and frame portions 110, 112 of the bag retaining mechanism 26. In this manner, the engagement between the liner and frame portions 110, 112 of the bag retaining mechanism 26 indicative of the secured state 28 of the bag retaining mechanism 26 defines an at least partial securing force that maintains the bin liner 12 within the first position 22. In such an embodiment, rotational operation of the bin liner 12 may require initial additional force to release the liner portion 110 from the frame portion 112 of the bag retaining mechanism 26.

Figure 10:
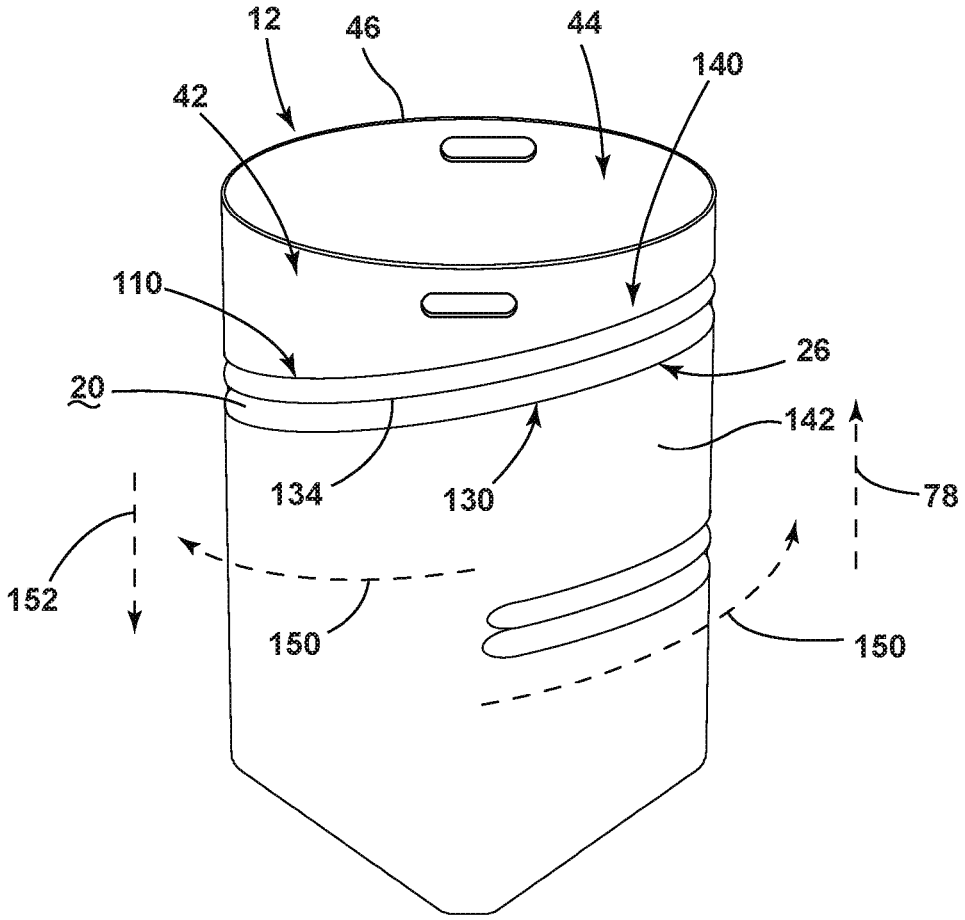
FIG. 10 is a perspective view of an alternate aspect of the bin liner showing the biasing surface disposed proximate an upper rim of the bin liner.
Figure 11:
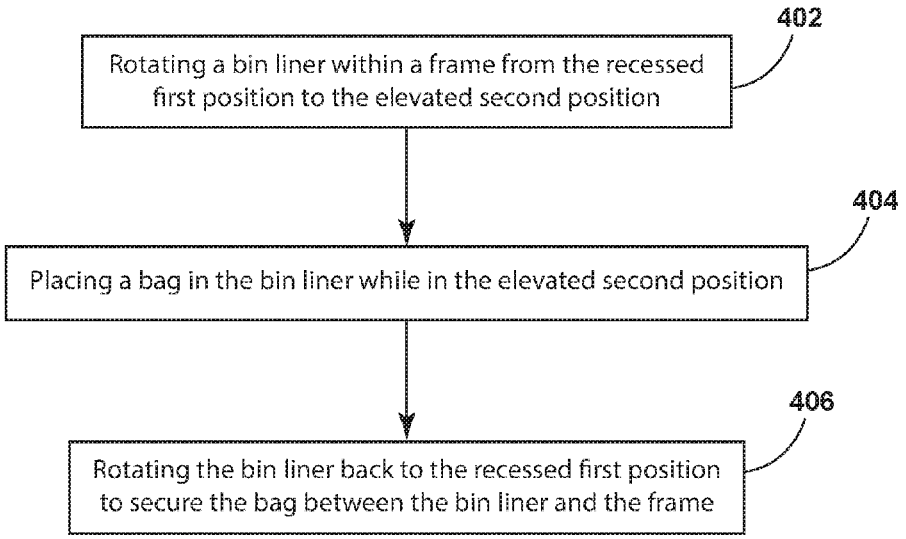
FIG. 11 is a linear flow diagram illustrating a method for operating a refuse bin incorporating an aspect of the bin liner having one or more biasing surfaces.

Referring now to FIG. 10, it is contemplated that the bag retaining mechanism 26 and the seating structure 18 can be defined by the same physical features defined within the bin liner 12 and the frame 14 of the refuse bin 10. According to the various embodiments, the seating structure 18 can be defined by a substantially helical structure 140 positioned proximate an upper rim 46 of the bin liner 12 and an upper edge 40 of the frame 14. This substantially helical structure 140 can be in the shape of a mating channel 130 that extends helically around and about the outer wall 142 of the bin liner 12. As discussed above, this mating channel 130, in the helical form, can also simultaneously define the liner portion 110 of the bag retaining mechanism 26 that engages and defines an interference fit with the frame portion 112 of the bag retaining mechanism 26. Accordingly, when the bag is installed on and into the bin liner 12, the bag can extend around the mating channel 130 of the helical structure 140. When the helical structure 140 of the liner portion 110 of the bag retaining mechanism 26 engages the frame portion 112, such as the protrusion 132, the helical structure 140 allows for a threaded type movement of the bin liner 12 within the frame 14 that secures the bin liner 12 within the frame 14 and also secures the bag between the liner and frame portions 110, 112 of the bag retaining mechanism 26.

According to the various embodiments, it is contemplated that the bag retaining mechanism 26 can include other structures that serve to pinch, constrict, compress, retain, hold, or otherwise dispose and secure the bag between the liner and frame portions 110, 112 of the bag retaining mechanism 26.

According to the various embodiments, it is contemplated that the rotational operation of the bin liner 12 within the seating structure 18 causes a rotational movement 150 of the bin liner 12 with respect to the seating structure 18 and also, according to various embodiments, alternative and generally upward and downward vertical movements 78, 152 of the bin liner 12 with respect to the seating structure 18. The result of this rotational movement 150 and vertical movement 78, 152 of the bin liner 12 between the first and second positions 22, 24 is to selectively separate and engage the liner portion 110 of the bag retaining mechanism 26 and the frame portion 112 of the bag retaining mechanism 26.

According to the various embodiments, the incorporation of the opposing biasing surfaces 74 and bottom ridge 76 of the bin liner 12 may function as a deterrent to taking the bin liner 12 from the refuse bin 10 for use as a separate trash container. Because the bin liner 12 includes the bottom ridge 76, the bin liner 12 does not have a sturdy base 60 that can hold the bin liner 12 upright on its own. Accordingly, the frame 14 is necessary for holding the bin liner 12 upright for use as a trash receptacle.

It is also contemplated, according to the various embodiments, that the rotational movement 150 of the bin liner 12 that corresponds to the upward and downward vertical movements 78, 152 can be used to gradually raise and lower the bin liner 12 within the frame 14. In this manner, after a bag has been placed on the bin liner 12, the bin liner 12 can be slowly lowered from the elevated second position 24 to the recessed first position 22. Through this slow and gradual movement, air from the interior cavity 16 of the frame 14 can be permitted to slowly pass between the frame 14 and the bin liner 12 as the bin liner 12 displaces the air within the interior cavity 16 of the frame 14. This is particularly true where the frame 14 includes a solid outer wall that is free of apertures. This displaced air is gradually released such that the force of this displaced air does not separate the bag from the bin liner 12. Additionally, this displaced air is further prevented from detaching the bag from the bin liner 12 through the minimal upward and downward movement 78, 152 as the bin liner 12 operates against the seating structure 18. Where the frame is solid, the displaced air is only able to be released through the space defined between the bin liner 12 and the frame 14. Through this minimal and gradual movement of the bin liner 12 within the frame 14, this displaced air does not blow or otherwise push the bag off from the bag from the bin liner 12 as the bin liner 12 is lowered to the recessed first position 22.

According to various embodiments, the engagement between the bottom of the bin liner 12 and the seating structure 18 disposed in a base 60 of the frame 14 can include other cooperative structures. These cooperative structures can include, but are not limited to, threaded engagements, helical-type engagements, upwardly and downwardly stepped interfaces, combinations thereof, and other similar engagements that allow for the rotational movement 150 and respective upward and downward vertical movement 78, 152 of the bin liner 12 with respect to the frame 14.

It is further contemplated that the bin liner 12 and refuse bin 10 can be made to define various shapes that allow for vertical and rotational movement 150 of the bin liner 12 within the frame 14. Typically, such a shape will be generally circular or generally arcuate. However, helical shapes can also be used in conjunction with various helically extruded shapes such as a helically extruded polygon where a helically extruded bin liner 12 having an arcuate, irregular or polygonal cross section can be rotationally and operated in a vertical movement within a frame 14 having an interior surface that at least partially matches the helically extruded shape of the bin liner 12.

Referring now to FIGS. 1-11, having described various aspects of the refuse bin 10 having the rotationally and vertically operable bin liner 12 that defines the bag retention mechanism, a method 400 is disclosed for operating a refuse bin 10 having the bin liner 12 with at least one biasing surface 20. According to the method 400, the bin liner 12 is rotated within the frame 14 from the recessed first position 22 to the elevated second position 24 (step 402). Once in the second position 24, a bag can be placed within the bin liner 12 and over an upper edge 40 of the bin liner 12 while in the elevated second position 24 (step 404). As discussed above, in the elevated second position 24, the upper edge 40 of the bin liner 12 extends above a portion of the frame 14 such that the upper edge 40 of the bin liner 12 is accessible for manipulation of the bag relative to the bin liner 12. This manipulation can include, but it not limited to, removal, replacement, installation, and other manipulations of the bag with respect to the bin liner 12. Once the bag is secured to the bin liner 12, the bin liner 12 is rotated from the elevated second position 24 back to the recessed first position 22 to secure a portion of the bag between the bin liner 12 and the frame 14 (step 406). As discussed above, the bin liner 12 and the frame 14 typically define the bag retaining mechanism 26. The bin liner 12 and the frame 14 each include a liner portion 110 and a frame portion 112, respectively, of the bag retaining mechanism 26.

According to the various embodiments, it is contemplated that the bag retaining mechanism 26 can be defined by a smooth surface of one of the bin liner 12 and the frame 14, while the other of the bin liner 12 and the frame 14 includes some geometric or physical formation that serves to secure the bag between the bin liner 12 and the frame 14.

According to the various embodiments as exemplified in FIGS. 1-9, it is contemplated that a pre-existing frame 14 can be retrofitted to include the disclosed bin liner 12 and the seating structure 18 that serves to operate the bin liner 12 between the first and second positions 22, 24. In such a retrofitting example, the seating structure 18 can be disposed within a base 60 of the existing frame 14 or other portion of the existing frame 14. The bin liner 12 can be inserted within the interior cavity 16 of the frame 14 to cooperatively engage the seating structure 18 to allow for rotation between the first and second positions 22, 24 and to further define the secured and maintenance states 28, 30 of the bag retaining mechanism 26. Accordingly, in such an embodiment, a bin liner 12 and cooperative seating structure 18 can be installed within an existing frame 14 for retrofitting of the existing frame 14 to define various aspects of the refuse bin 10 disclosed herein.

According to the various embodiments, the bin liner 12 can be made of various materials that can include, but are not limited to, plastic, metal, composite materials, polymers, combinations thereof and other similar materials. It is further contemplated that the seating structure 18 can be made of various rigid materials that can include, but are not limited to, metal, plastic, polymers, combinations thereof and other similar substantially rigid materials that can be adapted to support the weight of the bin liner 12 and refuse disposed therein. It is further contemplated that the bin liner 12 and seating structure 18 can be disposed within a frame 14 made of any one of various materials used for public and private refuse bins 10. Such materials can include, but are not limited to, stone, concrete, metal, plastic, polymer, combinations thereof and other similar materials used within public spaces for outer frames 14 and decorative frames 14 for various refuse bins 10. Additionally, it is contemplated that the frame 14 can include a solid outer surface or can include an outer surface that defines one or more apertures through the structure of the frame 14. Also, by way of example, and not limitation, where the bin liner 12, seating structure 18 and/or the frame 14 are made of plastic, the bin liner 12, seating structure 18 and/or the frame 14 can be formed through various forming processes that can include, but are not limited to, roto-molding, thermoforming, injection molding, compression molding, blow molding, combinations thereof and other similar plastic forming processes.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A refuse bin comprising:

a frame defining an interior cavity and a seating structure;

a bin liner having a biasing surface that rotationally engages the seating structure to define a recessed first position characterized by the bin liner set within the interior cavity, and an elevated second position characterized by the bin liner being vertically offset from the frame, the first position being vertically and rotationally distal from the second position, the biasing surface and the seating structure adapted to vertically translate the bin liner between the recessed first position and the elevated second position in response to a rotational movement of the bin liner relative to the frame; and a bag retaining mechanism defined between the frame and the bin liner, wherein the first position defines a secured state of the bag retaining mechanism and the second position defines a maintenance state of the bag retaining mechanism.

2. The refuse bin of claim 1, wherein the seating structure is defined within the interior cavity.

3. The refuse bin of claim 2, wherein the seating structure is defined proximate a base of the frame.

4. The refuse bin of claim 1, wherein the seating structure includes a seating channel having a primary axis extending along the seating channel.

5. The refuse bin of claim 4, wherein the bin liner includes a base that includes the biasing surface, wherein the biasing surface of the bin liner includes opposing biasing surfaces that extend toward a bottom ridge, wherein alignment of the bottom ridge with the primary axis positions the bottom ridge within the seating channel to define the first position, and wherein rotation of the bin liner to the second position rotates the opposing biasing surfaces and the bottom ridge within the seating channel and biases the bin liner upward to define the second position.

6. The refuse bin of claim 5, wherein the second position is defined by the bottom ridge being out of alignment with the primary axis and resting on top of the seating channel.

7. The refuse bin of claim 6, wherein the seating channel includes a detent portion that defines the second position, wherein engagement of the bottom ridge in the detent portion substantially secures the bottom ridge within the second position.

8. The refuse bin of claim 5, wherein rotation of the bin liner from the first position to the second position slidably engages the opposing biasing surfaces against opposing flanges of the seating channel and upwardly biases the opposing biasing surfaces in a generally upward movement, and wherein rotation of the bin liner from the second position to the first position slidably engages the opposing biasing surfaces against the opposing flanges of the seating channel and biases the bottom ridge into the seating channel and into alignment with the primary axis.

9. A refuse bin comprising:

a bin liner rotationally operable relative to a seating structure to define first and second positions of the bin liner, the second position being rotationally distal from the first position; and a bag retaining mechanism wherein the first position defines a secured state of the bag retaining mechanism adapted to secure the bin liner to a portion of the bag retaining mechanism and wherein the second position defines a maintenance state of the bag retaining mechanism adapted to separate the bin liner from the portion of the bag retaining mechanism, wherein the seating structure is adapted to vertically translate the bin liner between the secured state and the maintenance state during rotational operation of the bin liner.

10. The refuse bin of claim 9, wherein the first position defines a first vertical position with respect to the seating structure and the second position defines a second vertical position with respect to the seating structure, the second vertical position being vertically distal from the first vertical position.

11. The refuse bin of claim 10, further comprising:

a frame defining an interior cavity, wherein the bin liner is rotationally operable within the interior cavity to engage the seating structure, wherein the seating structure is at least partially defined within the frame, and wherein rotation of the bin liner between the first and second positions vertically operates the bin liner within the frame between the first and second vertical positions, and wherein the second vertical position is above the first vertical position.

12. A refuse bin comprising:

a bin liner selectively engaged with a seating structure and rotationally operable relative to the seating structure between first and second positions, the second position being rotationally and vertically distal from the first position, wherein the second position is adapted to define a separation of the bin liner from a portion of a bag retaining mechanism, wherein the seating structure is adapted to generate vertical movement of the bin liner between the first and second positions.

13. The refuse bin of claim 12, further comprising:

a frame defining an interior cavity, wherein the bin liner is rotationally operable within the interior cavity to engage the seating structure, wherein the seating structure is at least partially defined within the frame, and wherein rotation of the bin liner between the first and second positions vertically operates the bin liner within the frame.

14. The refuse bin of claim 13, wherein the bag retaining mechanism includes a liner portion and a frame portion, wherein the first position defines a secured state of the bag retaining mechanism characterized by the liner portion engaging the frame portion, and the second position defines a maintenance state of the bag retaining mechanism characterized by the liner portion being distal from the frame portion.

15. The refuse bin of claim 13, wherein the first position defines a first vertical position with respect to the interior cavity and the second position defines a second vertical position with respect to the interior cavity, the second vertical position being above the first vertical position.

16. The refuse bin of claim 15, wherein the seating structure includes a seating channel having a primary axis extending along the seating channel.

17. The refuse bin of claim 16, wherein the seating channel is positioned proximate a base of the frame.

18. The refuse bin of claim 16, wherein the bin liner include a base having opposing biasing surfaces that extend toward a bottom ridge, wherein alignment of the bottom ridge with the primary axis positions the bottom ridge within the seating channel to define the first position, and wherein rotation of the bin liner to the second position rotates the opposing biasing surfaces and the bottom ridge within the seating channel and biases the bin liner upward to define the second position.

19. The refuse bin of claim 13, wherein the bag retaining mechanism includes a liner portion and a frame portion, wherein the liner and frame portions of the bag retaining mechanism are separated when in the second position, and wherein the liner and frame portions of the bag retaining mechanism are engaged with one another in the first position.

* * * * *